US005295822A

United States Patent [19]

Hemsath

[11] Patent Number: 5,295,822

[45] Date of Patent: Mar. 22, 1994

[54] CONVECTIVE HEAT TRANSFER BY CASCADING JET IMPINGEMENT IN A BATCH COIL ANNEALLING FURNACE

[75] Inventor: Klaus H. Hemsath, Toledo, Ohio

[73] Assignee: Indugas, Inc., Toledo, Ohio

[21] Appl. No.: 48,678

[22] Filed: Apr. 19, 1993

Related U.S. Application Data

[62] Division of Ser. No. 695,434, May 3, 1991, Pat. No. 5,228,513.

[51] Int. Cl.[5] ..... F27B 3/22

[52] U.S. Cl. ..... 432/146; 432/176; 432/206; 432/212; 432/213; 266/254

[58] Field of Search ..... 432/206, 146, 175, 176, 432/152, 212, 213

[56] References Cited

U.S. PATENT DOCUMENTS

| | | | |
|---|---|---|---|
| 2,875,997 | 3/1959 | Blackman | 432/206 |
| 4,596,526 | 6/1986 | Soliman | 432/206 |
| 4,830,610 | 5/1989 | Hemsath | 432/146 |
| 4,846,675 | 7/1989 | Soliman | 432/206 |
| 4,854,863 | 8/1989 | Hemsath | 432/176 |
| 5,018,707 | 5/1991 | Hemsath et al. | 432/212 |

*Primary Examiner*—Henry C. Yuen

*Attorney, Agent, or Firm*—Frank J. Nawalanic

[57] ABSTRACT

An improved convective heat transfer arrangement is disclosed achieving overall heat transfer efficiencies in the neighborhood of 30 Btu/(hr. ft$^2$°F.). A heat transfer conduit including a heat transfer wall is axially divided into a plurality of axially extending heat transfer chambers by a plurality of transversely extending baffles. Each baffle is especially configured to have an axially extending recess formed therein through which extends an orifice opening. Heat transfer gas pumped through the conduit cascades through the heat transfer chambers forming and reforming nascent free standing jet streams through each baffle orifice which impinge the heat transfer wall to achieve very high heat transfer coefficients while efficiently utilizing the available heat in the heat transfer gas.

6 Claims, 4 Drawing Sheets

CONVECTIVE HEAT TRANSFER BY CASCADING JET IMPINGEMENT IN A BATCH COIL ANNEALLING FURNACE

This is a division of application Ser. No. 695,434 filed May 3, 1991, entitled 'Convective Heat Transfer by Cascading Jet Impingement' now U.S. Pat. No. 5,228,513 issued Jul. 20, 1993.

This invention relates generally to heat transfer by convection and more particularly to convective heat transfer in heat exchangers.

While the invention has specific application to and will be described with particular reference to various forms of conventional type heat exchangers, the invention also has application to various specific heat transfer applications and will also be described with specific reference to effecting heat transfer to coiled steel strip in batch coil annealing furnaces.

BACKGROUND OF THE INVENTION a) Conventional Type Heat Exchangers

It is beyond the scope of this patent to attempt to define the various conventional heat exchanger designs currently available in the art. Generally speaking, heat exchangers can be somewhat classified by certain design characteristics. For example, heat exchangers can be finned or unfinned and designed to have large or small pressure drop of the heat transfer fluid flow therethrough. The flow can be classified as either laminar or turbulent or parallel or cross flow. Structurally, the exchanger can be defined as tube type of plate type. Whether or not the heat exchanger is of the plate type or tube type and whether employing fins or unfinned and whether using cross flow (turbulent) or parallel flow (laminar) or large or small pressure drops, inherent in the transfer of heat is a boundary layer between the fluids which heretofore limited the heat transfer coefficient, $H_c$, in heat exchangers to values in the range of 5–10 btu/(hr. ft$^2$°F.).

b) Furnace Art

Within the furnace art, there are applications where heat must be convectively transferred to or from the work at extremely high heat transfer rates. In certain applications, high convective heat transfer rates have been achieved by using free standing gas jets to directly impinge the work. Two examples of jet impingement can be found in my U.S. Pat. No. 4,830,610 and my U.S. Pat. No. 4,693,015. In my '015 patent, heated jets are used for paper drying. In my '610 patent, heated jets are used to impinge a hollow cylindrical shell to effect high heat transfer therewith. In such applications as well as in numerous strip line applications, a gas is pressurized in a conduit which contains precisely machined orifices or alternatively slits which direct a high speed gas jet to impinge the work, generally normal or perpendicular to the work's surface. After impingement, the spent gas from the jet is simply dissipated into space as in a strip line. Alternatively, the spent jet is dispersed within the furnace chamber, as in my prior patents, to some point in the chamber where it is drawn back by a fan, heated, repressurized and pumped back into the conduit for reformation as a jet. Such arrangements require that the orifices or slits be of relatively small sizes precisely controlled in spacing and size to achieve the desired high heat transfer coefficients. In all such furnace applications, once the jet impinges the work, it is spent notwithstanding the fact that the gas from the spent jet still has heat of enthalpy or sensible heat or available heat which is not utilized. Thus, the concept of jet impingement, widely used in the furnace art, has, heretofore, not believed to have found application in the heat exchanger art, at least in the form to be discussed hereafter. That is, while both heat exchanger and furnace applications are obviously concerned with transferring heat, one of the primary concerns in the heat exchanger art is to utilize as much heat from the heat transferring fluid to produce an efficient design while the furnace application is only concerned with transferring heat at a predetermined high rate.

In this connection, it is also known from my previous work with Gas Research Institute to provide a gas fired heating mantle for heating a retort furnace. In the GRI heating mantle, a plurality of vertically spaced annular baffles in fluid communication with one another by "slotted jets" provides a mantle for heating a tubular member, i.e. a retort, connected to the inside diameter of the baffles. Heated products of combustion pass through the angularly offset slotted jets to create turbulent gas flow within each annular chamber thus utilizing the heat in an efficient manner. The turbulent gas flow improves the convective heat transfer to the retort but obviously not at the high convective heat rates achieved in jet impingement.

c) Batch Coil Annealing Furnaces

There are two methods for annealing steel strip which are in conventional use today. The first method which is conventionally accepted as the preferred method for achieving highest metallurgical and physical property control of the strip is to heat the strip as it continuously travels at high speed through looping towers past gas jets and which thereafter is wrapped into coils for shipment to the end user. The second older method of annealing strip is to stack the strip wound into coils vertically on their edges, one on top of the other, within a bell shaped annealing cover. Heated gas is then circulated about the coils within the cover to achieve annealing. Annular spacers are provided between adjacent covers and the spacers are open to permit furnace atmosphere to circulate between the edges of adjacent coils. Further, some spacers, i.e. convector plate spacers, have tabs or baffles which "wipe" the furnace atmosphere against coil edges as the furnace atmosphere passes through the spacer. Such arrangements improve the heat treatment at the edges of the coil. However, it is widely known and conventionally accepted that batch coil annealing does not produce consistent metallurgical strip characteristics, especially at the edges of the strip, which are achieved when the strip is annealed continuously.

SUMMARY OF THE INVENTION

It is a principal object of the invention to provide a convective heat transfer arrangement which obtains high heat transfer coefficients while efficiently utilizing the available heat from the heat transferring gas.

This object and other features of the invention are achieved in a convective heat exchanger for transferring heat from a heat transferring gas flowing therethrough which includes a plurality of similarly configured baffles axially spaced from one another. Each baffle has transversely extending first and second leg portions and an intermediate wall portion in between and contiguous with the first and second leg portions. An axially extending heat transfer wall is affixed to the end of one of the leg portions of each baffle for heat exchange with a heat transfer media disposed on the opposite side of the heat transfer wall. A sealing arrangement is affixed to the opposite end of the other one of the leg portions of each baffle to define a heat transfer gas conduit through which the heat transfer gas passes. In some embodiments, the sealing arrangement includes a sealing wall while in other embodiments, the sealing arrangement includes a second heat transfer wall. Each baffle transversely extends through the heat transfer gas conduit to define a plurality of axially spaced heat transfer chambers, with each chamber axially extending between adjacent baffles. An orificing arrangement is provided in each intermediate portion of each baffle for forming and directing a free standing jet stream of heat transfer gas against the heat transfer wall to achieve high convective heat transfer therewith while providing the only source of fluid communication between adjacent heat transfer chambers to efficiently use the available or sensible heat of the heat transferring gas as the gas cascades through the heat transfer conduit.

In accordance with another important feature of the invention, the baffles are positioned relative to one another such that the intersection of the first leg portion with the intermediate portion of one baffle is spaced a predetermined axial distance from the intersection of the second leg portion and the intermediate portion of an adjacent baffle so that the spent jet stream from the first baffle is reformed and directed as a nascent, free standing jet against the heat transfer wall by the orificing arrangement in the adjacent baffle.

In accordance with a more specific feature of the invention, the heat transfer plate is formed generally flat and the sealing arrangement includes a generally flat casing generally parallel to the heat transfer plate to define a rectilinear heat transfer gas conduit therebetween with the baffles extending between the plates so that flow of the heat transfer gas through the heat transfer gas conduit occurs by the heat transfer gas passing through the orifice openings in the baffles. A second generally flat heat transfer plate generally parallel to the first heat transfer plate is provided to define a generally rectilinear work fluid conduit therebetween through which a heat transfer media, preferably gas, axially flows. A second plurality of baffles including orificing means for forming and directing the jet streams against the second heat transfer plate is provided, including a sealing arrangement, so that the heat exchanger functions as a plate heat exchanger.

In accordance with still another aspect of the invention, the heat transfer wall is formed as an axially extending tubular member containing a fluid, preferably liquid, flowing therethrough and the first leg portion of each baffle extends radially outwardly as an annular disk from the heat transfer tubular member and terminates at the intermediate wall portion which is shaped as an axially extending ring while the second leg portion extends radially outwardly as an annular disk from the intermediate wall portion and terminates at the sealing arrangement. The sealing arrangement includes an axially extended insulated tubular member affixed to the end of the second leg portion so that the insulated tubular member and the heat transfer tubular member form the heat transfer gas conduit as an annulus traversed by the baffles to provide a tubular heat exchanger.

In accordance with yet another specific feature of the invention, the heat transfer wall includes an axially extending first heat transfer tube, the interior of which defines the heat transfer gas conduit. A concentric, larger second heat transfer tube receives the first tube to define an annular work fluid chamber therebetween. The first leg portion of each baffle extends radially inwardly from the inside of the first heat treat tube as an annular disc and terminates at the intermediate wall portion. The intermediate wall portion is ring shaped and axially extends a fixed distance. The second leg portion extends from the opposite axial end of the intermediate wall portion as a flat circular disk so that the gas flows axially through the first heat exchanger tube past the baffles only by flowing through the orificing means to produce an inside-out tube type heat exchanger.

In accordance with yet another aspect of the invention, a method is provided for effecting convective heat transfer which includes the steps of providing an axially extending heat transfer gas conduit having a plurality of axially spaced baffles therealong. Each baffle spans the entire cross-section of the conduit and has at least one orificing opening extending therethrough and the gas conduit has at least one axially extending heat transfer plate at one side thereof. A stream of heat transfer gas initially at a predetermined temperature $T_1$ and mass pressure $P_1$ is directed into the heat transfer gas conduit to impinge against the first baffle therein. When this occurs, i) a free standing jet of the gas at high velocity is formed as it passes through the orifice opening, ii) the free standing jet impinges the heat transfer plate to effect heat exchange between the heat transfer plate and the jet at very high heat transfer coefficients and iii) thereafter the spent jet gas now at a temperature $T_2$ and pressure $P_2$ is directed against the next adjacent baffle where it is reformed as a nascent, free standing at temperature $T_2$ and pressure $P_2$. The steps i–iii are sequentially repeated at successively different temperatures and pressures until the gas exits the gas conduit to provide very high heat transfer rates along the entire axial length of the heat transfer wall while effectively using the sensible or available heat in the heat transfer gas to provide an energy efficient method of heat transfer.

In accordance with more specific features of the method, the jet streams are directed generally perpendicular to the heat transfer plate to obtain maximum heat transfer coefficients and the orificing area and/or the spacing between adjacent baffles is varied to impart either uniform heat transfer along the entire axial length of the heat exchange plate or, alternatively, a varying heat transfer rate may be predeterminately established along the axial length of the heat transfer plate.

In accordance with another specific aspect of the invention, an improved convector spacer plate is provided for a batch coil annealing furnace which anneals steel strip wound into coils stacked one on top of the other and positioned on top a base plate. The furnace has an outer cover and an inner cover with the inner cover sealed to the base plate to define a sealed annealing chamber containing the coils. A fan is positioned beneath the base plate and the base plate has diffuser openings in fluid communication with the annealing chamber for causing furnace atmosphere to circulate at high flow rates under pressure from either the inside to the outside of the coils or from the outside to the inside of the coils. An annular convector spacer plate is positioned between and vertically supports the coils and in accordance with the invention, the spacer has a plurality of vertically extending support bars upon which the exposed edge of the coils rest. The support bars extend radially from the inside of the coils to the outside thereof and circumferentially divide the spacer into arcuate segments extending between adjacent support bars about the spacer. Within each segment, a plurality of radially spaced baffles are provided. Each baffle arcuately extends between adjacent support bars while vertically extending the distance of the support bars to define a plurality of heat transfer chambers radially extending between adjacent baffles. Each baffle has a vertically centered radially protruding recess formed therein. Each recess has at least one orificing opening therethrough providing substantially the only fluid communication between adjacent chambers whereby furnace atmosphere is directed against the baffle adjacent one of the coil's radial ends and through the orificing opening to directly impinge against, as a free standing jet, the edges of the coil while flowing radially through the heat transfer chambers past successive baffles to form a plurality of free standing gas jets impinging the coil edges thus uniformly heating the coil edges and improving the metallurgical qualities imparted to the coils.

In accordance with another aspect of the invention, each baffle has a first leg portion extending vertically downwardly a fixed distance from the top of each support bar and a second leg portion vertically extending a fixed distance upwardly from the bottom of each support bar with a first intermediate wall portion extending radially from the first leg portion and a second intermediate wall portion extending radially from the second leg portion in the same radial direction as the first intermediate portion and a third interconnecting leg portion vertically extending between the first and second intermediate leg portions. Each intermediate leg portion has at least one orificing opening to form a free standing gas jet so that the jet in the first intermediate portion impinges the edges of the coil above the support bars and the jet in the orificing openings in the second intermediate portion impinges the edges of the coil below the support bars thus uniformly heating the edges of the coils above and blow the spacer and demonstrating the application of the invention to effect heat transfer of a gas to or from a solid.

It is a general and principal object of the invention to provide method and apparatus for a convective heat transfer arrangement which has any one of the following characteristics or combinations thereof:

a) high convective heat transfer rates;

b) a highly energy efficient design which utilizes more of the available or sensible heat from the heat transfer gas to effect heat exchange than prior art arrangements;

c) a design and/or method which does not require closely controlled tolerances to achieve jet impingement and results in high heat transfer coefficients;

d) a design and/or method which permits either a predetermined uniform heat transfer or a modulation or variation in the heat transfer to or from the load to be achieved;

e) a modular design which permits easy assembly;

f) a design which is commercially suitable for large installations;

g) a design and/or method suitable for use in both tube type and plate heat exchangers;

h) a design and/or method suitable for gas to gas, gas to or from liquid, and gas to or from solid heat transfer;

i) an efficient gas to fluid heat transfer which is further enhanced by utilizing counterflowing gas and fluid streams.

Yet another object of the invention is to provide method and apparatus for improved convective heat treating of coiled steel strip which homogenizes and accelerates the heat transfer to the strip edges of the coil resulting in improved metallurgical and physical properties of the annealed steel or other ferrous material.

Yet another object of the invention is to achieve overall, as contrasted to localized, convective heat transfer coefficients in the range of 30 to 50 btu/(hr. $ft^2$°F.).

Yet another object of the invention is a heat transfer arrangement characterized by a very high heat transfer coefficient affected in a simple and inexpensive design.

These and other objects, features and advantage of the invention will become apparent from the following description of species thereof taken together with the accompanying drawings.

BRIEF DESCRIPTION OF THE DRAWINGS

The invention may take physical form in certain parts and arrangement of parts, preferred and alternative embodiments of which will be described in detail herein and illustrated in the accompanying drawings which form a part thereof and wherein:

FIG. 1 is a graph plotting the cross-sectional temperature of a fluid flowing through a conduit with the temperature plotted on the y axis and the cross-sectional distance of the conduit plotted on the x axis;

FIG. 6 is a schematic end view of a gas to liquid, outside-in tube type heat exchanger employing my invention;

DETAILED DESCRIPTION OF THE PREFERRED EMBODIMENT

Figure 10:
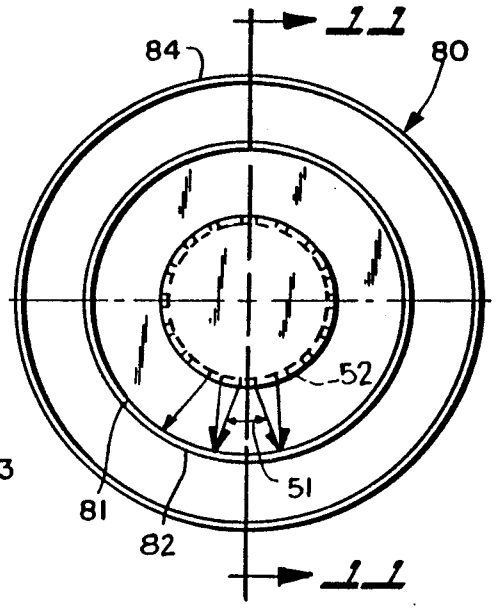
FIG. 10 is a schematic end view of a tube type, inside-out gas to liquid heat exchanger of my invention.

My invention relates to a convective heat transfer arrangement and before referring to the drawings wherein the showings are for the purpose of illustrating preferred and alternative embodiments of the invention only and not for the purpose of limiting same, it will be helpful in understanding and appreciating my invention to discuss in general some basic heat transfer concepts and the utilization of those concepts to date in the prior art.

Generally, the transferred heat flow (Q) from one mass to another can be expressed by the equation:

$$Q = h_c \times A \times LMTD$$

Where:

$h_c$ is the heat transfer coefficient expressed as btu/(hr. ft$^2$°F.).

A is effective heat transfer area (ft$^2$).

LMTD is the log mean temperature difference between fluids (deg. F.).

To increase heat transfer, it should be quite obvious that only A and $h_c$ can be optimized. For reasons which will now be explained, variable A can only have a limited increase on the heat transferred Q.

The effective area A represents the combined direct fluid contact area and the effects of extended surface area. For most extended surfaces, either on tubes or on flat plates, the effective area can be approximated by using the following relationship:

$$A = A_f \times (A_f/a_w)(-0.375)$$

Where:

$A_f$ is the total outside surface area including the fin surface area; and $a_w$ is the heat exchange surface area in contact with the fluid.

From the above relationship, it can be seen that the effective extended surface area becomes less and less effective as the fin area is increased. In other words, the fin surface area follows the rule of diminishing return. For example, when the fin surface area is two (2) times the base area, its effectiveness is 77%, and when the fin area is increased to be three (3) times the base area, its effectiveness is only 66%. Thus, for practical reasons, the extended surface area cannot be used to increase the heat flux by more than a factor of 2–2.5 compared to the unfinned area.

Similarly, a relationship can be developed between a necessary heat transfer area and the pressure drop or horsepower which must be used to move the fluid flow across the heat exchanger. Such a relationship can be given in the equation:

$$A = C_3 \times (HP)(-0.21)$$

Where:

$C_3$ is a constant which depends on the heat exchanger design and on the properties of the fluid, and HP is the horsepower which must be expended to move the fluid.

This equation indicates that the area requirement only decreases very slowly when taking larger and larger pressure drops for moving air across a heat exchanger. For example, increasing the horsepower by a factor of two (2) can reduce the heat transfer area by only 16%.

Thus, the most expedient way to increase the heat flux is to increase the heat transfer coefficient.

For fluid with given operating pressures and temperatures, the heat transfer coefficient for flow over flat surfaces or across aligned tubes depends on the fluid flow velocity and the flow configuration over the heat transfer surfaces. The relationship between $h_c$ and velocity (v) at fully developed flow conditions is usually given in the form of:

$$h_c = \text{Constant} \times v(0.632)$$

Where:

The constant is a value assigned to the heat transfer through the tube wall and for all intents and purposes is negligible. This indicates that for parallel or cross flow situations, the increase in velocity will be effective with a power of less than 1.

In heat exchangers, when the flow is in the early transition conditions as is the case when entering the heat exchanger or when flow disturbances impeded the flow, the local $h_c$ values can be 1.5 to 1.8 times higher than the average values given by the above mentioned equation. However, the length and effective heat transfer area where such increased values can be maintained is relatively small (less than 10% of the overall heat exchange area) for most conventional designs. As a result, for most practical air to water heat exchanger designs, the overall maximum values of air side heat transfer coefficient $h_c$ are limited to the range of 5–10 btu/(hr. ft$^2$°F.).

This can be better explained by reference to the graph schematically drawn in FIG. 1 in which the temperature of the fluid indicated by line 10, i.e. the heat transfer to the fluid, varies over the cross-sectional length of the conduit containing the fluid. At the juncture of the heat transfer between the fluids, i.e. the interface, there is a boundary layer indicated at 12 on the graph shown in FIG. 1 which is inherently formed and which inherently exists in any heat transfer. In conventional heat exchangers and as noted in the preceding paragraph, before the flow of the transferring fluid stabilizes, i.e. during its turbulent stage, the boundary layer 12 temporarily decreases with the result that locally, i.e. 1 point along the axial length or short distance along the axial length, the heat transfer coefficient will increase 1.5 to 1.8 times the value given in the above equation. However, the boundary layer as the fluids move in contact with one another, reestablishes itself resulting in the heat transfer coefficient velocity formula expressed above.

It is known in the furnace art that the use of high velocity, free standing jets impinging against the work will markedly result in an increase in the heat transfer coefficient because the heat transfer boundary layer 12 can be markedly decreased. It is known that the heat transfer coefficient can easily exceed 50 btu/(hr. ft$^2$°F.).

Figure 2:
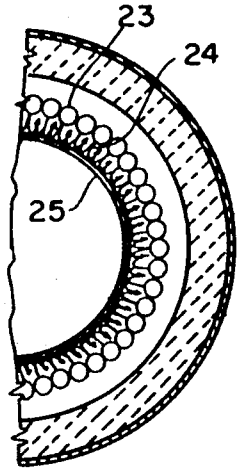
PRIOR ART FIG. 2
FIG. 2 is a schematic partial end view in section of a prior art furnace.
Figure 3:
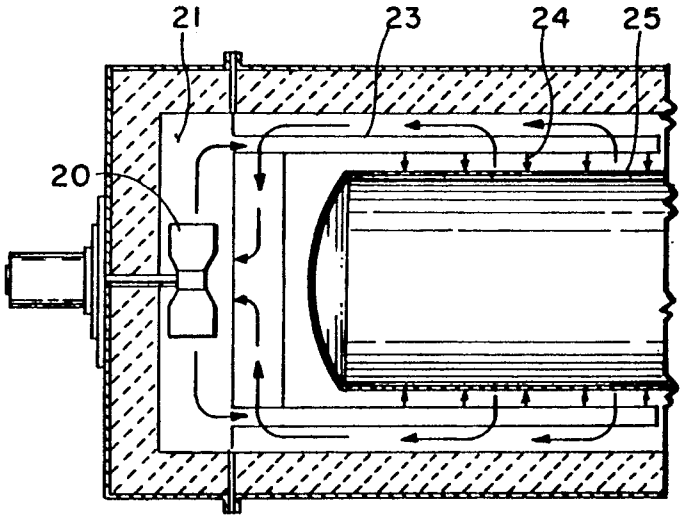
PRIOR ART FIG. 3
FIG. 3 is a schematic partial longitudinal view in section of the prior art furnace shown in FIG. 2.

The status of convective heat transfer within the furnace art is illustrated in the Indugas furnace shown in FIGS. 2 and 3 and this particular furnace is covered by a number of my patents. The jet transfer arrangement I grammatically illustrated in FIGS. 2 and 3 is explained in some detail in my U.S. Pat. No. 4,830,610 and reference can be had to that patent for a more detailed explanation. Basically, a fan 20 in a plenum chamber 21 pressurizes heated furnace atmosphere which is forced into closed end pipes or distribution tubes 23. Tubes 23 have orifices along their axial length for developing free standing jets 24. Jets 24 impinge an imperforate cylindrical shell 25 which contain the work to be heat treated therein. After impingement, the spent jets are pulled through an under pressure zone created by fan 20 back into plenum chamber 21 where the gas is again pressurized and directed through tubes 23. Free standings jets 24 are at high velocities and develop very high convective heat transfer rates when they impinge shell 25 and the heat from shell 25 then radiates to metal work within the shell. In this type of design, as well as the jets used on strip lines, jet arrangements used in the paper drying field and the jet arrangements used to achieve high speed cooling in carburizing heat treat furnaces, after initial impingement, the jet is gone. Whatever sensible heat, pressure or energy or work which remains in the jet is lost.

Figure 4:
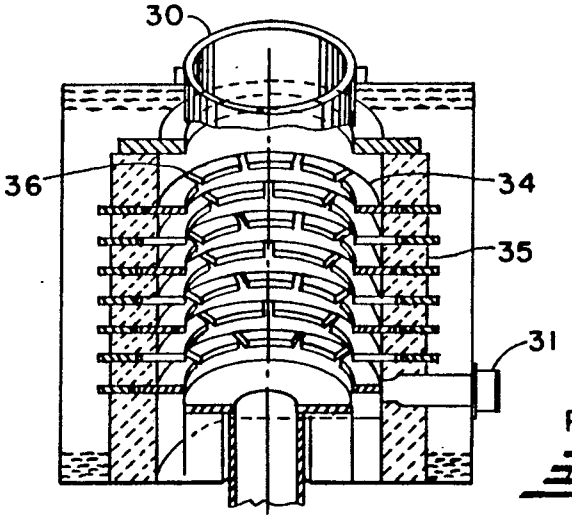
PRIOR ART FIG. 4
FIG. 4 is a schematic sectioned, elevation view of my prior art mantle.

An arrangement which better utilizes the available heat is the mantle I developed for a retort furnace for Gas Research Institute in Chicago, Ill. which is diagrammatically illustrated in vertical section in FIG. 4. Details of the device, which is the subject of a pending patent application, are available from GRI. In FIG. 4, a retort 30 having work, usually granular material, is heated by a gas fired burner 31 directing products of combustion under pressure into a plurality of annular chambers defined by annular baffles 34. Baffles 34 extend between retort 30 and an annular refractory wall 35 which radiates heat to retort 30. Radially extending slots 36 are provided in baffles 34 and the slots in one baffle are offset from the slots in an adjacent baffle providing a tortuous path for the products of combustion as they travel vertically upward along the length of retort 30. Slots 36 act like air knives and provide a rectangular stream or a knife or pressurized gas which impinges against the next adjacent vertical baffle to create gas turbulence within each annular chamber. Thus, each chamber has turbulent gas flow impinging refractory wall 35 and retort 30 to result in improved radiant heat transfer to retort 30 and a higher heat transfer coefficient to retort 30 than what is otherwise obtainable in a laminar flow arrangement. Thus, my mantle, to some extent, discloses an arrangement which efficiently uses the sensible heat from burner 31 in a turbulent flow arrangement but one which does not have the high convective heat transfer characteristics of jet impingement.

In contrast to my other inventions, my present invention utilizes high speed jet impingement to obtain very high heat transfer coefficients while efficiently utilizing most of the available or sensible heat inputted to the exchanger.

Figure 7:
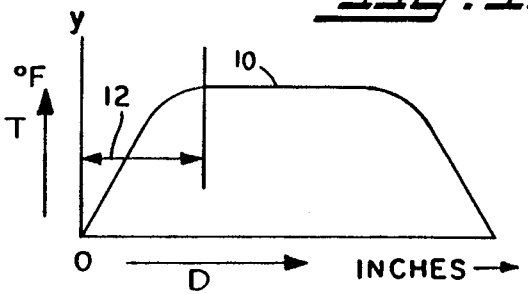
FIG. 7 is a longitudinally sectioned view of the heat exchanger shown in FIG. 6 taken along lines 7—7.

My invention is best illustrated and described with reference to its application to heat exchangers. In FIGS. 6 and 7, a gas to liquid heat exchanger 40 is illustrated. In this arrangement, a liquid is flowing through a thin walled tube 41 which defines a work fluid conduit therein. Concentrically positioned and overlying tube 41 is an outer tube 43. The annular space 42 between inner tube 41 and outer tube 43 defines a heat transfer conduit through which a heat transfer gas indicated by the arrows in FIG. 7 axially flows. Insulation 44 is applied to the inside of outer tube 43.

Inner tube 41 is connected to outer tube 43 by a plurality of axially spaced baffles, sequentially designated 45*a*, 45*b*, 45*c*, . . . 45*n*. Baffles 45 divide heat transfer conduit 42 into a series of heat transfer chambers 42*a*, 42*b*, . . . 42*n* with each heat transfer chamber, i.e. 42*b*, axially extending a predetermined distance between adjacent baffles 45*a*, 45*b*. Each annular baffle has a transversely extending first leg portion 47, a second transversely extending leg portion 48 and an intermediate axially extending wall portion 49. For terminology purposes, axial means a direction parallel with the longitudinal centerline 50 of heat exchanger 40 and is the direction of flow of fluid through heat exchanger 40. Transverse means extending at an angular direction to centerline 50 and not necessarily perpendicular thereto. With respect to the embodiment shown in FIGS. 6 and 7, it should be clear that first and second leg portions 47, 50 are transversely extending annular portions and that intermediate portion 49 is shaped as an axially extending ring contiguous with the end portions of first and second leg portions 47, 48. In construction, thin axially extending metal strips (not shown) extending between leg portions 47 or 48 can be provided to secure all baffles 45*a* . . . 45*n* in proper spaced relationship to one another and provide an assembly which can then be easily modularized. The baffle assembly is then fitted between inner and outer tubes 41, 43 by welding or press fit. Alternatively, for large field erected installations, each baffle 45*a* . . . 45*n* can be individually fitted in place.

Spaced, preferably at equal circumferential increments, about intermediate portion 49, is a plurality of orificing openings 52. It is preferred that the circumferential spacing of orificing openings 52 between adjacent baffles 45*a*, 45*b* or 45*b*, 45*c*, etc., is offset from one another although the invention will function if openings 52 are in axial alignment with one another. It is specifically contemplated that orificing openings 52 be circular. In theory, openings 52 could be slotted or shaped in a particular configuration. However, for maximum heat transfer, orifice openings 52 are circular and are of a dimensional size to develop a free standing cone jet 51 therethrough. More particularly, as schematically illustrated in FIG. 6, orificing openings 52*a* are dimensioned relative to fluid flow, pressure, etc. to produce a right angle cone jet 51 such that the cone of one jet intersects with the cone of an adjacent jet when the jets contact inner tube 41. Again, the invention will work if the cones do not intersect with one another at tube 41. However, for maximum heat transfer, the jet pattern described produces uniform heat transfer circumferentially about the entire tube. This concept applies to all the other embodiments of my invention.

Referring now, and particularly to FIG. 7, adjacent baffles, i.e. 45*a*, 45*b* or 45*b*, 45*c*, etc., are axially spaced apart from one another a distance indicated at reference number 53 which is the axial spacing between the intersection or juncture of intermediate wall portion 49*a* with second leg portion 48*a* of one baffle and the juncture or intersection of first leg portion 47*b* with intermediate wall portion 49*b* of an adjacent baffle. This axial spacing must be at least as great as the axial distance, i.e. the diameter, of orificing opening 52. As can be best visualized in FIG. 7, free standing jet 51 impacts inner tube 41 after which it is conventionally termed a "spent jet". As more and more gas is pushed through orificing openings 52, the spent jet passes through baffle axial space 53 (which in the embodiment of FIG. 7 is annular) and pressurizes the volume in the second heat transfer chamber 42*b*, specifically the space bounded by second leg portion 48*a* of one baffle, second leg portion 48*b* of an adjacent baffle and intermediate wall portion 49*b* of the adjacent baffle. The free standing jets are thus reformed by orificing openings 52*b* in adjacent baffle 45*b* and the reformed or nascent jets 51*b* similarly impinge inner tube 41. Because the only fluid communication between adjacent heat transfer chamber 42*b*–*c*, 42*c*–*d*, etc. is through orifice opening 52, the gas flow inputted to heat transfer gas conduit 42 thus cascades through baffles 45*a*–45*n* forming and reforming jet streams 51*a*–51*n* as the heat transfer gas travels the axial length of heat exchanger 40.

Figure 13:
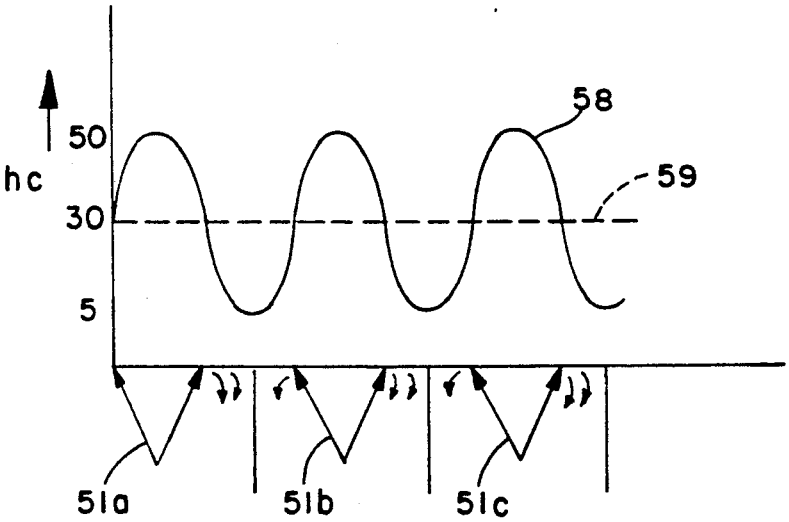
FIG. 13 is a graph showing the value of the heat transfer coefficient obtained along the axial length of the heat exchanger.

Still referring to FIG. 7, it should be clear that a high heat transfer coefficients in excess of 50 Btu/(hr. ft$^2$° F.)

occurs over that axial portion of inner tube 41 which is equal to the diameter of the jet cone and, further, because of spacing between first leg portion 47*a* of one baffle and first leg portion 47*b* of another baffle, turbulent flow of the spent jet is occurring over that area of inner tube 41 not indirectly impinged by the projected cone of the free standing jet. This turbulent flow has a much higher heat transfer coefficient than that of a laminar jet and is in the order of magnitude of the heat transfer coefficient obtained in my retort arrangement disclosed in FIG. 4, i.e. about 20 to 30 Btu/(hr. ft$^2$°F.). Thus, over the axial distance of inner tube 41, the heat transfer boundary layer is drastically reduced because of direct jet impingement and the boundary layer starts to rise or increase over that area of the heat transfer wall exposed to turbulent flow even though the area impacted by turbulent flow has a much higher heat transfer coefficient than that previously obtained. However, the second jet stream, i.e. 51*b*, is then effective to again reduce the heat transfer boundary layer which again tends to rise in areas adjacent to the direct jet impingement until the next successive nascent jet again impinges inner tube 41. This is graphically illustrated in FIG. 13 where the heat transfer coefficient is assumed to take a sinusoidal distribution over the projected area of the jet stream 51 and is shown by curve 58. As the jet stream velocity increases to very high flow, the amplitude of the curve will, of course, increase and the curve will tend to assume a square configuration. Jet stream velocities of 2,000 fpm to as high as 10,000 fpm are contemplated. Thus, the cascading effect of the heat transfer gas flow through baffles 45 forming and reforming nascent jets which successfully impinge inner tube 41 prevents the heat transfer boundary layer from increasing along the axial distance of heat exchanger 40 to achieve overall a very high heat transfer to the liquid flowing within inner tube 41 throughout the axial length of heat exchanger 40. That is, the average, overall heat transfer achieved is about 30 Btu/(hr. ft$^2$° F.) and is represented by dashed line 59 in FIG. 13 which bisects the area of curve 58.

Finally, it should be clear that the heat transfer gas is pumped into heat transfer conduit 42 at a constant pressure and temperature and when it impacts first baffle 45*a*, the heat transfer gas undergoes a pressure drop from $P_a$ to $P_b$ as the gas travels through orifices 51*a* and the temperature of the gas drops when it impinges inner tube 41 from its initial temperature $T_a$ to second temperature $T_b$. Thus, at second baffle 45*b*, the gas which is reforming or making a nascent jet 51*b* is at pressure $P_b$ and a temperature $T_b$ and when jet 51*b* is spent, the heat transfer gas which forms jet 51*c* is at a temperature Tc and Pressure Pc. In this way, the available or sensible heat of the heat transfer gas is efficiently utilized to make a highly efficient heat exchanger. If uniform heat transfer is desired along the entire axial length of inner tube 41, then the size of orifice openings 51 will progressively vary from baffle 45*a* to baffle 45*n* and/or axial spacing 53 will very. It will thus be apparent to those skilled in the art that by varying orifice size and/or baffle spacing, any desired heat transfer pattern or distribution can be achieved along the axial length of heat exchanger 40. As a practical matter, this is not any problem because the flow of the work fluid in work flow conduit in counter to the flow of the heat transfer gas in heat transfer conduit 42. Thus, baffles 45 are shown equally spaced so that the heat transfer to the liquid can be gradually increased as the liquid travels from the entrance to the exit end of the work flow conduit. If parallel flow was used, the orifice sizing and/or baffle spacing might be varied.

Figure 8:
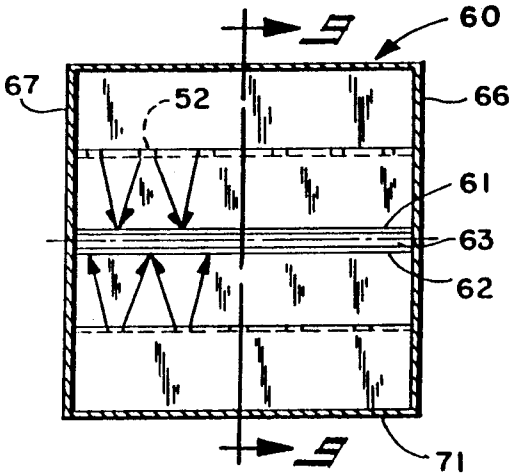
FIG. 8 is a schematic end view of a gas to gas, plate type heat exchanger employing my invention.
Figure 9:
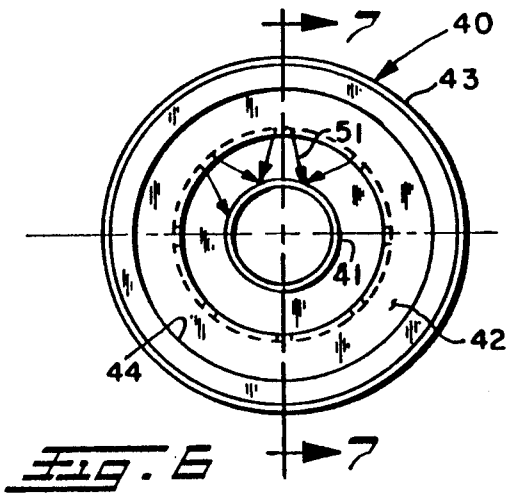
FIG. 9 is a longitudinally sectioned view of the heat exchanger shown in FIG. 8 taken along lines 9—9.
Figure 5:
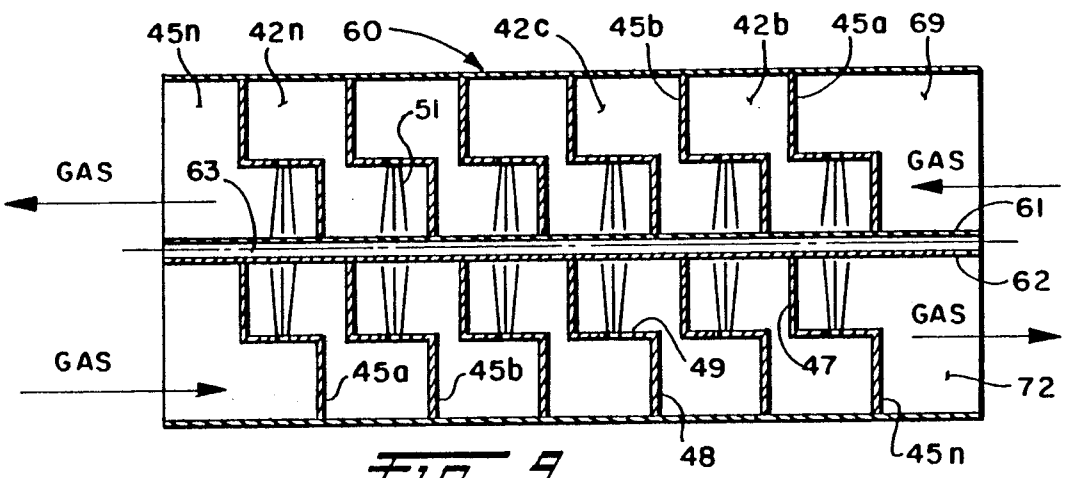
Figure 7:
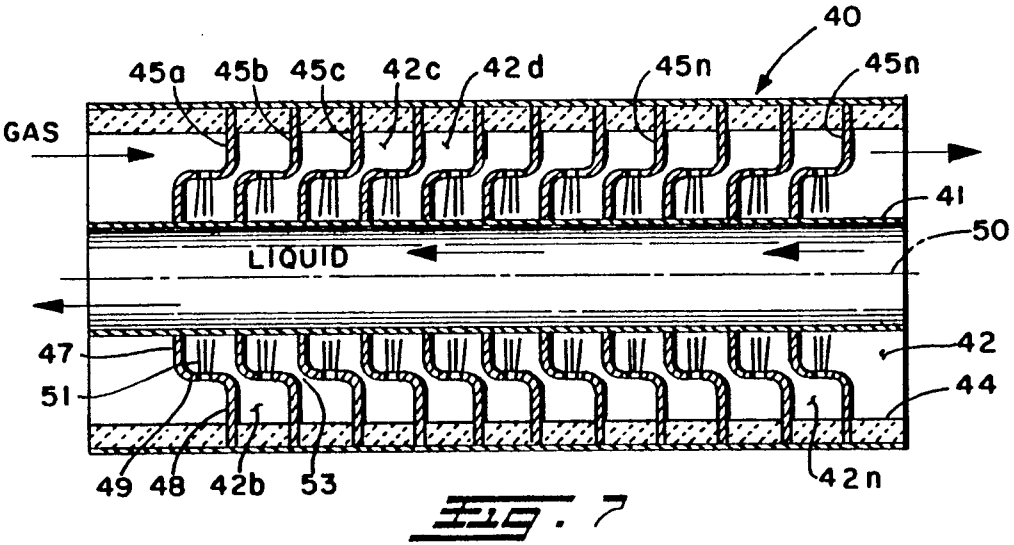

Referring now to FIGS. 8 and 9, my invention is shown as a plate heat exchanger 60 typically used to effect heat transfer from gas to gas. In plate heat exchanger 60, there is a generally flat heat transfer plate 63 having opposed flat heat transfer plate surfaces 61, 62 (FIG. 8). A first sealing plate 65 generally parallel to first heat transfer plate 61 and closed by end walls 66, 67 (FIG. 8) defines a generally rectilinear, axially extending first heat transfer gas conduit 69. Similarly, a second sealing plate 71 spaced from and generally parallel to second heat transfer plate 62 and bounded by end wall 66, 67 defines a generally rectilinear, axially extending second heat transfer gas conduit 72. A plurality of axially spaced baffles 45*a*–45*n* are provided in first heat transfer conduit 69 and form a plurality of axially extending heat transfer chambers 42*a*, 42*b* . . . 42*n*. Baffles 45 in the plate heat exchanger are rectilinear in overall shape whereas baffles 45 in tube type heat exchanger of FIGS. 6 and 7 are annular in configuration. The shape of baffles 45*a* for the plate heat exchanger in FIGS. 8 and 9 is otherwise identical to the FIGS. 6 and 7 embodiments. Each baffle 45*a* comprises a first transversely extending leg portion 47, a second transversely extending leg portion 48 and an intermediate wall portion 49 with orifice openings 52 formed therein to develop free standing annular jets 51 which intersect with heat transfer plate 61, 62 as shown in FIG. 8. At this point, it should be noted that intermediate wall portion 48 in conjunction with one of the leg portions 47 or 48 is basically forming a recess in which orifices 52 are positioned. Other baffle constructions having recesses or pockets formed therein to catch the heat transfer gas flow and form jets 51 will suggest themselves to those skilled in the art. The same convective heat transfer described with reference to FIGS. 6 and 7 occurs in FIGS. 8 and 9. In FIG. 9, heat transfer gas inputted into heat exchanger 60 is shown flowing in one axial direction in first heat exchanger conduit 69 and in the opposite direction flow in second heat transfer conduit 72. Thus, counterflow is established between first and second heat transfer plate 61, 62 and that area of heat transfer plate 61, 62 which is not directly impinged by free standing jets but which is subjected to turbulent gas flow will experience enhanced heat transfer to improve overall heat transfer efficiency. While this is desirable, the invention would work if the heat transfer gas flows in both first and second heat transfer conduits 69, 72 were in the same direction with one another. If this was desired, then one of the baffle sets in one of the heat transfer conduits would have to be reversed to duplicate the tube type heat exchanger cross-sectional configuration shown in FIG. 11.

Figure 11:
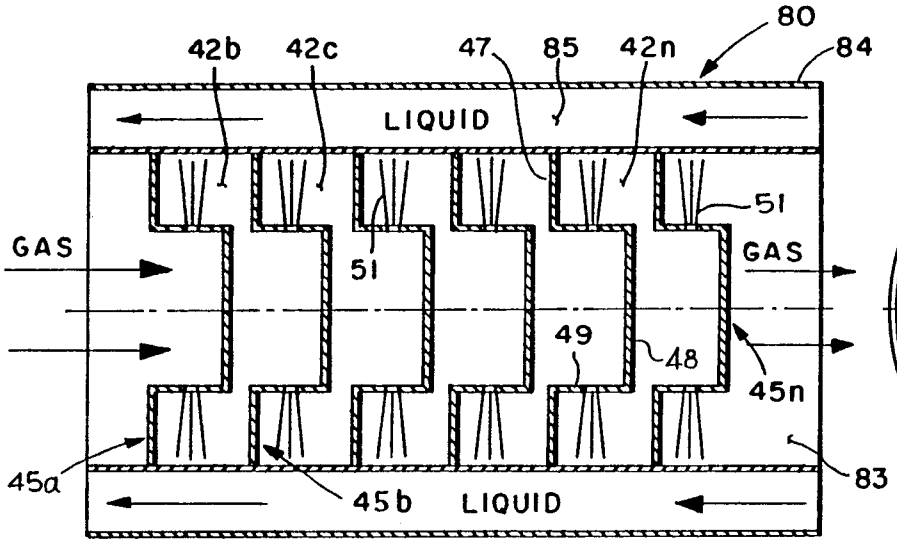
FIG. 11 is a longitudinal view of the heat exchanger shown in FIG. 10 taken along lines 11—11.

Referring now to FIGS. 10 and 11, there is disclosed an inside to outside, gas to liquid, tube type heat exchanger 80 which employs my invention. In this embodiment, the wall of an inner tube 82 defines the heat transfer surface 81 and the interior space of inner tube 82 defines heat transfer conduit 83 while outer tube 84 circumscribing inner tube 82 defines an annular work fluid conduit 85 through which, preferably, a liquid flows. A plurality of baffles 45*a*, 45*b*–45*n* are axially spaced along the length of heat transfer conduit 83 to produce a plurality of axially extending heat transfer chambers 42*b* . . . *n*. As in the other embodiments, each baffle has a first leg portion 47 which in the embodiment of FIGS. 10 and 11 is annular in configuration, an intermediate wall portion 49 which in the embodiment of FIGS. 10 and 11 is ring shaped and axially extending, and a second leg portion 48 which in the embodiment of FIGS. 10 and 11 is circular. The operation of tube type heat exchanger 80 is identical to the previous embodiments described above. Heat transfer gas is continually pumped against the baffle recess or depression formed between intermediate wall portion 49 and second leg portion 48 and when the heat transfer gas is consistently pumped against the depression caused by those baffle portions, nascent jet streams are formed through orifices 52 to effect heat transfer at very high rates as described above. In the embodiment of FIGS. 10 and 11, sealing wall 43 shown in the embodiment of FIGS. 6 and 7 and sealing walls 71 shown in the embodiment of FIGS. 8 and 9 is not needed since heat transfer wall 82 functions also as the sealing wall.

Figure 5:
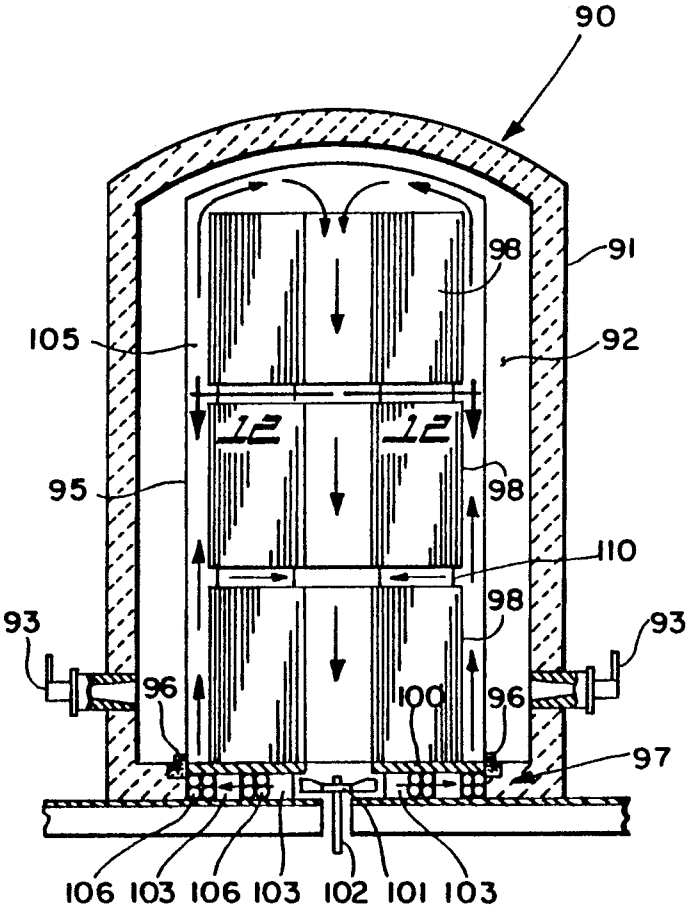
PRIOR ART FIG. 5
FIG. 5 is a schematic sectioned, elevation view of a prior art, batch coil annealing furnace.
Figure 12:
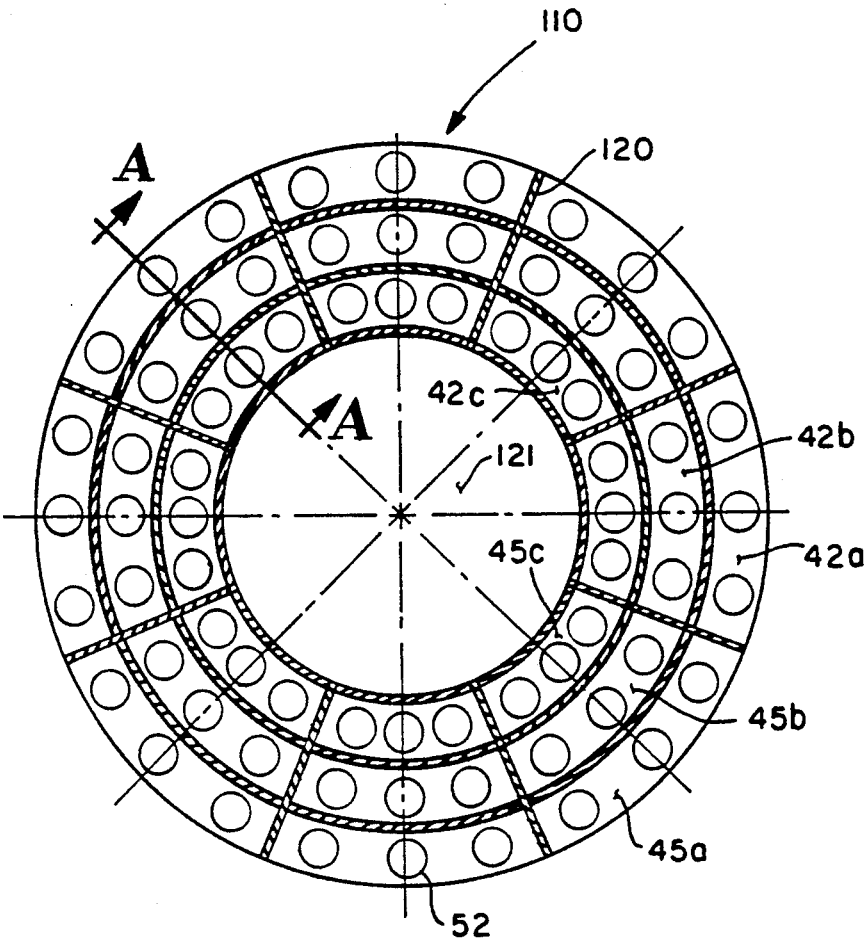
FIG. 12 is a schematic cross-section of a spacer constructed in accordance with my invention taken along lines 12—12 of FIG. 5.

The high convective heat transfer rates achieved in the heat exchangers of FIGS. 6 through 11 which are either gas to gas or gas to liquid or liquid to gas devices can also be effected in a gas to solid heat exchange mechanism. Such an application is illustrated in FIGS. 5 and 12. In FIG. 5 there is shown a bell-shaped, batch coil annealing furnace 90. Bell-shaped annealer 90 has an outer refractory wall 91 defining a heating chamber 92 contained therein and typically gas fired burners 93 provide heat to heating chamber 92. Within heating chamber 92 is an imperforate inner cover 95 having a flanged end 96 which sits within sand bed 97 to form a sand seal so that the space 105 within inner cover 95 is sealed. Steel strip wound in coils 98 are stacked on edge, one on top of the other, and rests on a base plate 100. A radial fan 101 driven by fan shaft 102 causes a furnace atmosphere (typically nitrogen scavenged with hydrogen) to flow through diffuser openings 103 in base plate 100 to pump at high velocity and mass flow the furnace atmosphere into the space 105 within inner cover 95 in the direction shown by the flow arrows in FIG. 5. Cooling coils 106 are also provided within the base plate arrangement for cooling coils 98 after the soak time of the annealing cycle has been completed.

As noted, coils 98 are stacked one on top of the other and are separated from one and the other by annular convector plates 110. (Also, there is a convector plate between the bottom coil and base plate 100, not shown). Heretofore, convector plates 110 had axial openings and radial passages permitting the furnace atmosphere within inner cover 95 to radially travel in the direction indicated by the arrows in FIG. 5 from the outside of steel coils 98 to the inside thereof and, in the process, "wipe" the edges of steel coils 98. Also, it is known in the art that the flow pattern shown in FIG. 5 can be reversed depending upon the positioning of diffuser openings 103 so that the circumferential flow path through the convector plates would be from the inside of the coils to the outside of coils 98.

Referring now to FIG. 12, there is shown a cross-sectional end view of an annular convector spacer plate 110 constructed in accordance with the principles of my invention. Annular convector spacer plate 110 includes a plurality of vertically extending support bars 120 and the exposed edges of coils 98 rest on the top and bottom of support bars 120. Support bars 120 extend radially from a position approximately adjacent the inside diameter of steel coils 98 to a position approximately adjacent the outside diameter of steel coils 98. Support bars 120 circumferentially divide annular convective spacer 98 into a plurality of arcuate segments 121, there being eight (8) such segments shown in FIG. 12. Within each segment 121 is a plurality of radially spaced baffles 45, there being three (3) such baffles **45*a*, 45*b* and 45*c* shown in FIG. 12 forming three radially spaced heat transfer chambers 41*a*, 42*b* and 41*c*. Reference can be had to FIG. 11 for a vertical cross-sectional view taken along line A—A of FIG. 12 of what the baffles 45 would look like in configuration. The orientation of baffles 45 in FIG. 11 would be reversed if the flow of furnace atmosphere in inner cover 95 were reversed to travel from inside to outside instead of outside to inside. Baffles 45 extend then as arcuate segments between adjacent support bars 120 and would be tied or welded to adjacent support bars 120. Alternatively, baffles 45*a*, 45*b* and 45*c* can be formed as a modular group secured to one another by stringers axially extending between first leg portions 47 and secured to support bars 120 (not shown). When furnace fan 101 pumps the atmosphere through inner cover 95, the furnace atmosphere will cascade through annular convector spacer plate 110 passing sequentially through baffles 45*a*, 45*b* and 45*c* vis-a-vis orifice openings 52 to generate free standing jets which would impinge the exposed edges of the coil strip above and below annular convector spacer plate 110. As with the heat exchanger embodiments illustrated in FIGS. 6 through 11, orifice openings 52 can be varied and spacing between adjacent baffles likewise varied to impart a desired heat transfer rate to the exposed edges of coil strip 98** with the result that the entire coil can be uniformly annealed at even heat rates to prevent problems with edge metallurgy which previously afflicted steel strip annealed in batch annealing furnaces.

Improving convective heat transfer has many technical and economic implications. Enhanced heat transfer results in reduced equipment sizes and better energy recovery. It is especially important in applications where the annual production of goods is large and where quantities of heat are used at more modest temperatures as in steam raising, fluid heating, and crude oil heating to name a few.

Fluid carrying heat transfer members are usually manufactured in tube or plate form. This design decreases costs and permits to control large internal fluid pressures. The disadvantages of these devices (steam tubes in a boiler, oil tubes in a crude heater, and plates in a water heater) is that they can usually produce only heat transfer coefficients which are normally in the range of 4 to 10 Btu/sqft-hr-°F. More unusual flow patterns can sometimes create coefficients in the range between 10 and 20 Btu/sqft-hr-°F. and in a very few instances heat transfer coefficients exceeding 30 Btu/sqft-hr°F. have been reported when heat is exchanged between ambient pressure gases and metallic surfaces.

The present invention is based on the well known fact that heat transfer from impinging jets is rather large when compared to parallel flow. By replacing the parallel flow arrangement with a multiplicity of jets, heat transfer can be improved by 200 to 300%. However, only a few jet assemblies have found widespread application due to the usually more limited field of use that these devices offer. Typical examples are in the paper industry and other web processing industries (steel, aluminum, plastics) where jet based heat transfer has been used more widely.

The present invention can be used on any flat or cylindrical surface. The invention deliberately wants to extract the maximum amount of heat and is, therefore, designed for use in counterflow devices. However, cross flow, or parallel flow patterns can equally be employed with diminished thermal efficiencies.

The device directs an array of jets against a cylindrical wall, hitting it in several radial locations. The jets impinge upon the cylinder surface and are deflected upward. They are then deflected away from the surface and feed the next series of jets.

For a cylindrical heat transfer device (a tube filled with liquid) several identical pieces are required along its length. These heat transfer modules are rather simple in design but are rather flexible in shaping heat transfer along such a tube. One can design for uniform heat transfer, graduated heat transfer, and can even create moderate maxima and minima.

A flat surface in the form of either a circle or a rectangle cannot use this module but uses another configuration which is, however, based on exactly the same principles. In this arrangement the fluid medium is led through a similar configuration.

For certain applications (plate heat exchangers) it is advantageous to put such a device between plates. In the following drawings these different heat transfer enhancement modules are shown and described.

Also refer to my earlier U.S. Pat. Nos. 4,693,015; 4,830,610; 4,891,008; pending Ser. No. 323,290, filed Mar. 14, 1989 by Procedyne, now U.S. Pat. No. 5,018,707.

The invention has been described with reference to preferred embodiments. Obviously, alterations and modifications will occur to those skilled in the art upon reading and understanding the invention described herein. It is intended to include all such modifications and alterations insofar as they come within the scope of the present invention.

Having thus defined the invention, it is claimed:

1. In a batch coil annealing furnace for annealing a plurality of wound steel strip coils stacked one on top of the other and positioned on top a base plate, said furnace having an outer cover and an inner cover with said inner cover sealed to said base plate to define a closed sealed annealing chamber containing said coils, a fan positioned beneath said base plate and said base plate having a plurality of diffuser openings in fluid communication with said annealing chamber for causing furnace atmosphere to circulate at high flow rates under pressure within said inner cover from either inside to the outside of said coils or from the outside to the inside of said coils, and an annular, convertor plate spacer between and vertically supporting said coils, the improvement comprising:

said spacer having a plurality of vertically extending support bars upon which the exposed edge of said coils rest for supporting the weight thereof, said support bars radially extending from the inside of said coils to the outside thereof and circumferentially dividing said spacer into arcuate segments extending between adjacent support bars about said spacer;

within each segment a plurality of radially spaced baffles, each baffle extending between adjacent support bars and vertically the distance of said support bars to define a plurality of radially extending heat transfer chambers, each baffle having a vertically centered, radially protruding recess formed therein and each recess having at least one orificing opening provided therethrough for fluid communication between adjacent heat transfer chambers whereby said furnace atmosphere is directed to flow against a baffle adjacent one of the coils' radial ends and through said orificing opening to impinge against the edges of said coil while flowing radially along said spacer through successive heat transfer chambers and during the course thereof forming a plurality of free standing gas jets impinging said coil edges.

2. The batch coil annealing furnace of claim 1 wherein each baffle has a first leg portion vertically extending downwardly a fixed distance from the top of said support bar, a second leg portion vertically extending a fixed distance upwardly from the bottom of said support bar, a first intermediate portion extending radially from said first leg portion, a second intermediate portion extending radially from said second leg portion in the same radial direction as said first intermediate portion and a third interconnecting leg portion vertically extending between said first and second intermediate leg portions, each intermediate leg portion having at least one orificing opening to form a free standing gas jet so that said jet in said first intermediate portion impinges said edges of the coil above said support bars and said jet in said orificing opening in said second intermediate portion impinges said edges of the coil below said support bars.

3. The batch coil annealing furnace of claim 1 wherein said intermediate portions extend radially outwardly to cause said furnace atmosphere to cascade through said spacer from the inside of said coils to the outside thereof.

4. The batch coil annealing furnace of claim 1 wherein said intermediate portions extend radially inwardly to cause said furnace atmosphere to cascade through said spacer from the outside of said coils to the inside thereof.

5. The batch coil annealing furnace of claim 1 wherein means are provided for interconnecting all baffles in each segment to form a modular baffle assembly.

6. The batch coil annealing furnace of claim 4 further including means for interconnecting said spacer bars to one another to form an annular spacer frame, said frame receiving said modular baffle assembly in each of its segments.

* * * * *